US007188507B2

(12) United States Patent
Holliday et al.

(10) Patent No.: US 7,188,507 B2
(45) Date of Patent: Mar. 13, 2007

(54) COAXIAL CABLE FITTING AND CRIMPING TOOL

(75) Inventors: Randall A. Holliday, Broomfield, CO (US); Robert M. Parker, Aurora, CO (US)

(73) Assignee: International Communication Manufacturing Corp., Denver, CO (US)

( * ) Notice: Subject to any disclaimer, the term of this patent is extended or adjusted under 35 U.S.C. 154(b) by 24 days.

(21) Appl. No.: 10/927,884

(22) Filed: Aug. 27, 2004

(65) Prior Publication Data

US 2006/0042346 A1 Mar. 2, 2006

(51) Int. Cl.
*H01R 43/042* (2006.01)

(52) U.S. Cl. ..... 72/409.14; 29/751; 29/282; 29/283.5

(58) Field of Classification Search ..... 72/409.14; 29/751, 753, 282, 283.5
See application file for complete search history.

(56) References Cited

U.S. PATENT DOCUMENTS 2,369,180 A * 2/1945 Rosenthal ..... 29/566
3,126,750 A * 3/1964 Willis ..... 74/17.5
4,932,091 A 6/1990 Krzyzanski
5,105,648 A 4/1992 Steiner et al.
5,392,508 A 2/1995 Holliday et al.
5,546,653 A * 8/1996 Tournier et al. ..... 29/751
5,845,393 A 12/1998 DePaiva
5,934,137 A 8/1999 Tarpill
6,112,404 A 9/2000 Tarpill
6,293,004 B1 9/2001 Holliday
6,594,888 B2 * 7/2003 Chang ..... 29/751

* cited by examiner

*Primary Examiner*—Daniel C. Crane
(74) *Attorney, Agent, or Firm*—John E. Reilly; Ellen Reilly; The Reilly Intellectual Property Law Firm, P.C.

(57) ABSTRACT

A crimping tool for connecting a cable fitting to the end of a cable is made up of an elongated body having a lever arm pivoted at one end of the body to actuate a plunger having a chuck at one end toward and away from axially slidable die portions on the body, and the die portions can be expanded to permit insertion of the connector sleeve and cable into engagement with the end of the chuck and contracted to apply a uniform crimping force to the fitting in response to an axial force applied to the chuck to increase the crimping force causing the die portions to be further contracted into crimping engagement following which the die portions can be expanded to release the fitting and cable from the tool.

25 Claims, 4 Drawing Sheets

COAXIAL CABLE FITTING AND CRIMPING TOOL

BACKGROUND AND FIELD OF INVENTION

This invention relates to crimping devices, and more particularly relates to a novel and improved hand-held universal crimping tool for crimping fittings of different lengths into sealed engagement with cables, such as, for example, coaxial cables employed in the cable TV industry.

Hand-held crimping tools have been devised for crimping a connector onto the end of a coaxial cable and which are characterized in particular by being capable of reducing the diameter of the fitting into a generally circular configuration in response to an axially directed force to the fitting. Representative of these inventions are U.S. Pat. No. 5,392,508 for AXIAL DEFORMATION CRIMPING TOOL and U.S. Pat. No. 6,293,004 for LENGTHWISE COMPLIANT CRIMPING TOOL, both of said patents being owned by the assignee of this invention and incorporated by reference herein, the latter being characterized in particular by having a spring-loaded chuck on the end of a plunger which is axially advanced by a lever arm toward and away from an end stop into which a coaxial cable end and connector have been inserted. Movement of the plunger toward the end stop will force a crimping ring on the connector to radially contract the connector into crimping engagement with the cable end, and the spring-loaded chuck will compensate for differences in length of the fittings.

In my '004 patent, utilization of a preassembled crimping ring on the connector obviates utilization of a special die portion of the type disclosed in my '508 patent. Nevertheless, there are numerous applications where utilization of a die portion mounted on the body of the tool is preferred over the utilization of a preassembled crimping ring which remains on the cable end after the crimping operation. For example, the die portion eliminates the crimping ring and exerts more direct control over shaping of the fitting or sleeve into sealed engagement with the cable end. In the past, however, when the die portions have been mounted on the body of the tool they are difficult to open when the fitting becomes jammed; also the ability of the die halves to resist misalignment when subjected to crimping forces; and the ability of the tool to be self-adjusting for wear tolerances and other slight differences in size and length of each fitting or connector have presented problems in the field. Accordingly, there is an unmet need for a crimping tool which will overcome the above and other problems associated with cable crimping tools.

SUMMARY

It is therefore an object to provide for a novel and improved crimping tool conformable for use in compressing different sizes and lengths of fittings onto the end of a cable in a reliable and efficient manner.

Another object is to provide for a novel and improved hand-held crimping tool for crimping fittings into sealed engagement with a coaxial cable without requiring a preassembled crimping ring but is capable of achieving a uniform seal notwithstanding differences in length of the fitting, or to compensate for the presence of wear or dirt and differences in manufacturing tolerances.

A further object is to provide for a novel and improved hand-held crimping tool for terminating cable ends without the use of a preassembled crimping ring which greatly facilitates both mounting and release of the cable end before and after the crimping operation and wherein the tool is lightweight but sturdy and requires a minimum number of parts.

A still further object is to provide for a hand-held crimping tool for terminating coaxial cables and which enables interchangeable use of different sizes and shapes of die portions.

An additional object is to provide for a novel and improved coaxial cable fitting of the type having a crimping sleeve which is movable into sealed engagement with an end of a coaxial cable and which is conformable for use with various crimping tools including the hand-held crimping tool hereinafter described.

In one aspect of the present invention, a crimping tool has been devised for connecting the sleeve portion of a cable fitting to an end of a coaxial cable wherein the tool is provided with a cable-receiving die housing at one end, an elongated body having a plunger mounted for axial advancement through the body toward and away from the cable-receiving die housing and means for axially advancing the plunger toward and away from the die housing, the improvement comprising a plurality of die members mounted in the die housing for movement between a radially expanded position in which the cable fitting is slidable into contact with the plunger and a radially contracted position wherein relative advancement of the sleeve portion and the die members into engagement with one another causes the sleeve portion to be compressed into sealed, crimping engagement with the cable end.

In one embodiment, the die members are slidable radially and axially between the expanded and contracted positions in response to axial advancement of the plunger, and the die members are yieldingly urged toward the contracted position. The die members define circumferential portions of a common die cavity, and at least one of the die members is movable into and out of circumferential alignment with the other of the die members.

Another feature is that different sets of die members can be interchangeably mounted in the die housing according to the size and length of fitting to be crimped onto the cable end, and each set of die members defines a cavity having a first diameter corresponding to an outer diameter of the sleeve portion and a second diameter which corresponds to the outer diameter of the cable end. The housing itself is characterized by having inclined guideways on opposite sides of the housing to advance the die members between the expanded and contracted positions. The inclined guideways include end portions which increase the compressive force exerted by the die members on the sleeve portions in completing the crimping operation and are self-compensating for any manufacturing variance or wear of the die cavities and guide portions of the die members.

Still another feature resides in a coaxial cable fitting having a novel and improved crimping sleeve having a raised portion which will undergo reversal into an indented portion in sealed engagement with a cable end and which is adapted to be utilized with a crimping tool having a die member which will force the raised portion to undergo reversal into the indented position.

The above and other objects, advantages and features will become more readily appreciated and understood from a consideration of the following detailed description of different forms of the present invention when taken together with the accompanying drawings in which:

DETAILED DESCRIPTION

Figure 1A:
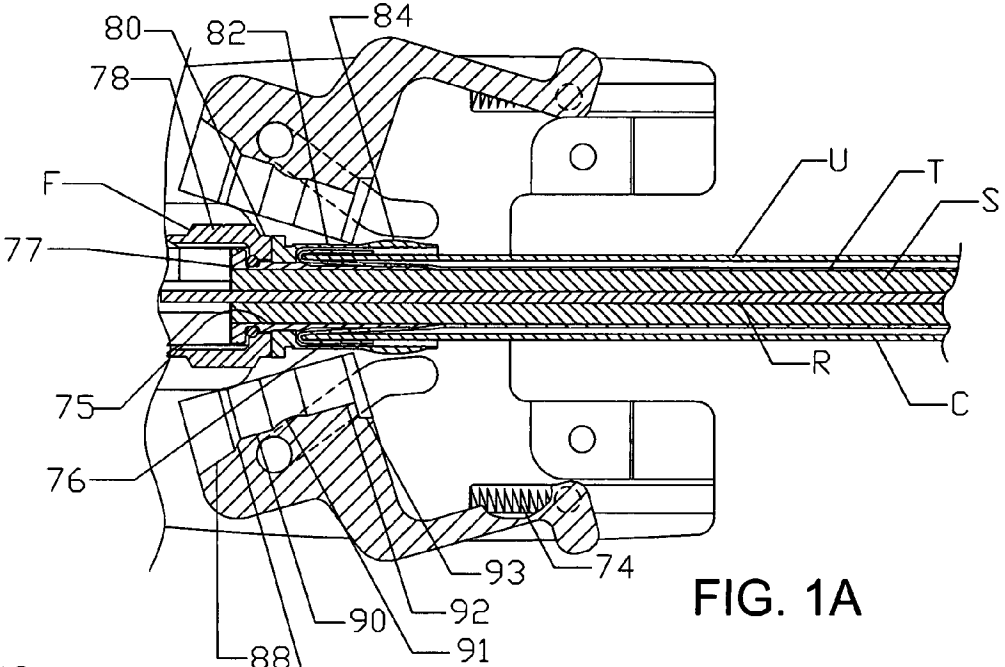
FIG. 1A is an enlarged fragmentary view of the die portions in their spread position for insertion of a fitting and cable end into engagement with a chuck as shown in FIG. 1; the crimping operation.
Figure 1:
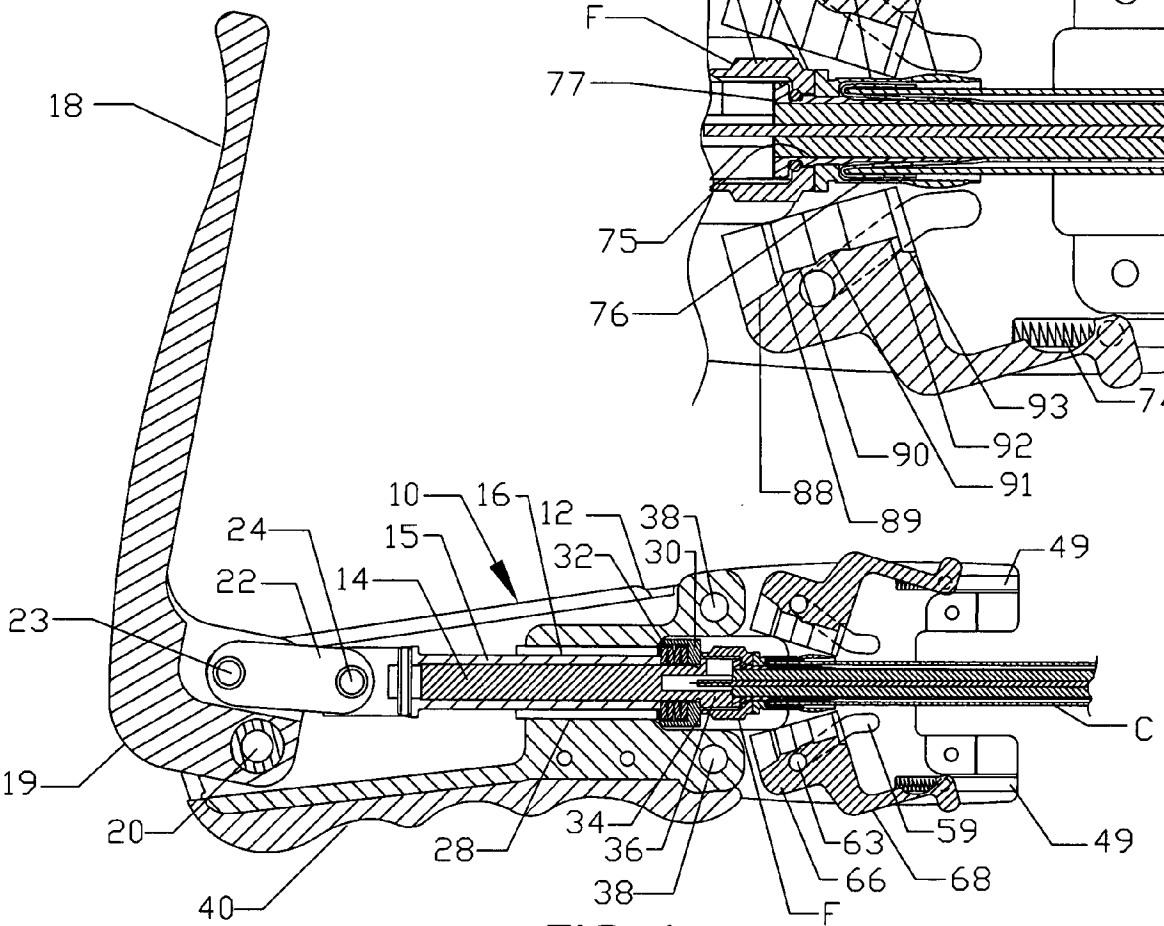
FIG. 1 is a longitudinal section view of a preferred form of crimping tool in accordance with the present invention.
Figure 2A:
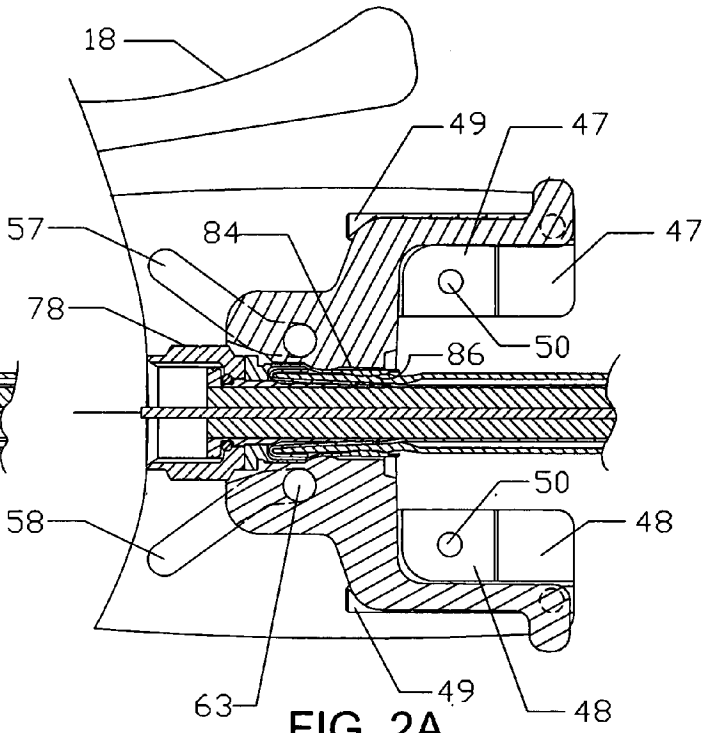
FIG. 2A is a detailed fragmentary section view of the die portions in their contracted position following the crimping operation.
Figure 2C:
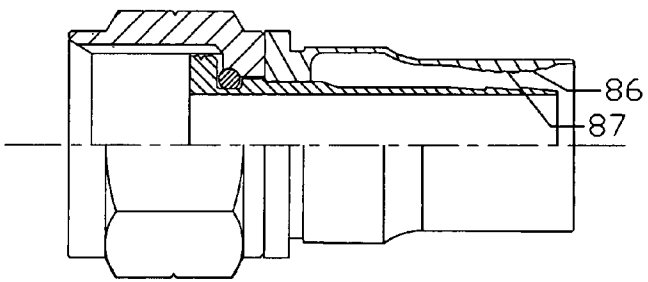
FIG. 2C is a sectional view of the connector illustrated in FIG. 2B after the crimping operation.
Figure 2:
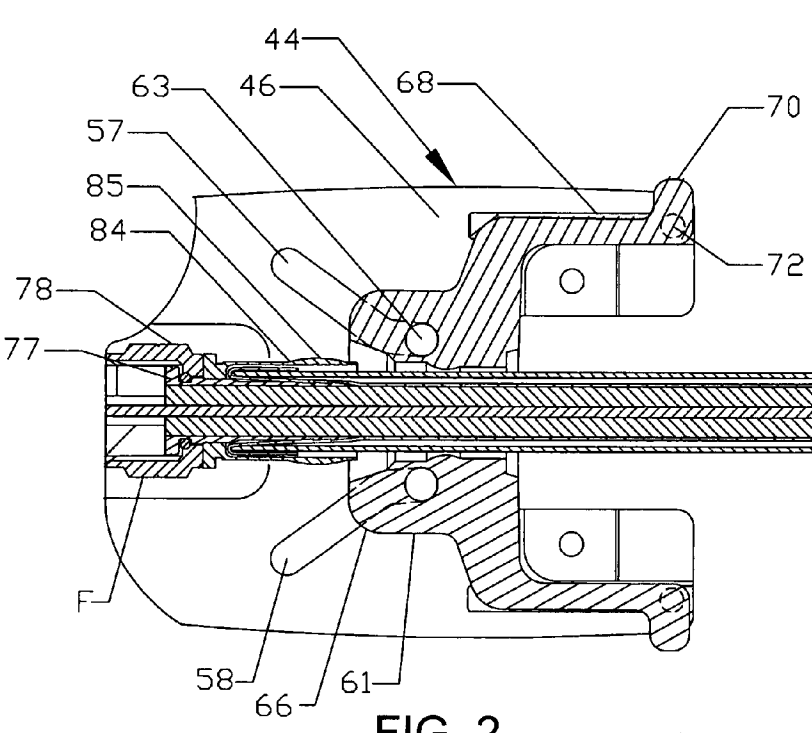
FIG. 2 is a detailed fragmentary section view of the die portions in their contracted position prior to the crimping operation.
Figure 3:
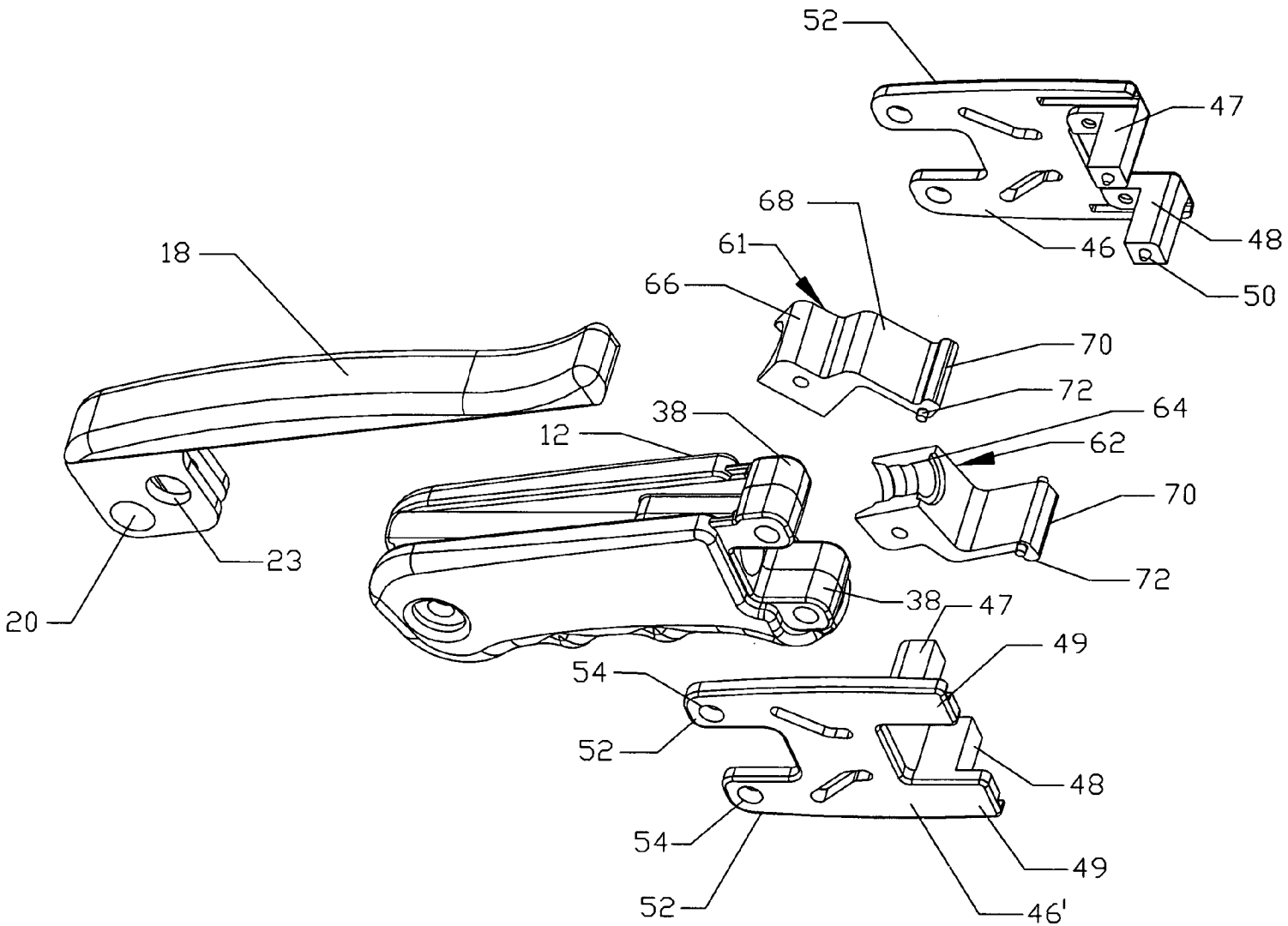
FIG. 3 is an exploded view of the preferred form of crimping tool shown in FIGS. 1 and 2.
Figure 5:
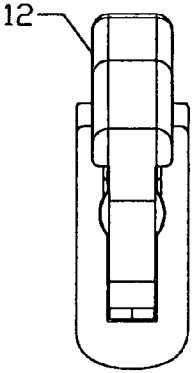
FIG. 5 is an end view of the main body of the preferred form of crimping tool.

Referring in more detail to the drawings, one form of handheld crimping tool 10 is shown in FIGS. 1 through 6 and is broadly comprised of an elongated body 12 of generally channel-shaped configuration, as best seen from FIGS. 3 and 5. A plunger 15 extends through a plunger-receiving bore 16 in the body, and a lever arm 18 has an offset end portion 19 pivotally mounted in the channel at the rear end of the body 12. A floating link 22 is pivotally attached at 23 in offset relation to the pivot 20 and pivotally attached at its opposite end 24 to an end of the plunger 14. Further, the lever arm 18 is of a width substantially corresponding to the width of the channel in the body 12 so as to be free to pivot from the extreme raised or upright position shown in FIG. 1 to the substantially horizontal position overlying the body 12, as shown in FIG. 2. The plunger 14 is slidable through bushing 28 in the bore 16 and terminates in a large hollow housing 30 for a spring stack 32. A sleeve 34 surrounds the leading end of the bushing 28, and the spring stack 32 bears against the end of the sleeve 34 when the lever handle 18 is advanced into the lowered or closed position as shown in FIG. 2.

A chuck 36 is secured to the end of the plunger 14 so as to mount the spring stack 32 under compression between the sleeve 34 and spring housing 32 and corresponds to the lengthwise compliant chuck of my U.S. Pat. No. 6,293,004 which is incorporated by reference herein. The trailing end of the body 12 terminates in upper and lower bosses 38, and the underside of the body is provided with grooves or depressions 40 to facilitate gripping of the tool 10.

A die support 44 defines an axial extension of the body 12 and is made up of generally rectangular guideways 46 and 46' in laterally spaced relation to one another and interconnected by upper and lower spaced braces 47 and 48 on rearward extension arms 49 of the guideways 46 and 46', each brace including a connecting pin 50 at its free end which is adapted to be inserted in snug-fitting relation to an aligned socket on the upper and lower arms 49 of the opposite guideway 46 or 46'. Leading arm members 52 on each of the guideways 46 and 46' are spaced apart such that they can receive the bosses 38 therebetween and have openings 54 which are aligned with the bosses 38 to receive a suitable fastener 56 to rigidly interconnect the die support to the end of the body 12.

A pair of upper and lower inclined slots 57 and 58 are formed in each of the guideways 46 and 46', the slots diverging away from one another in a direction toward the body 12, and the inner adjacent ends of the slots 57 and 58 each terminate in a slight dog leg or axially extending slotted portion 59. A pair of upper and lower complementary die halves in the form of circumferentially extending concave portions 61 and 62 are correspondingly formed and each includes a conical die cavity 64 in a die block 66 which extends at right angles to a thin flat arm portion 68, the latter terminating in a right angle flange 70 having a transversely extending pin 72. The pins 72 are adapted to fit into opposed upper and lower slots 49 extending axially between each brace 47, 48 and outer edge of each guideway. Each of the pins 72 is spring loaded or biased by a compression spring member 74 extending forwardly along each of the slots 49 toward the main body 12 so as to yielding urge the die members 61 and 62 in a rearward direction causing the pins 63 to be normally positioned in the slotted portion 59, as best seen from FIGS. 2 and 2A.

Forward advancement of the die members 61, 62, for example, by manually forcing the ends 70 along the slots 49 against the urging of the spring members 74 will cause the pins 63 to slide in outward, substantially diagonal directions through the slots 57 and 58 into the expanded position shown in FIGS. 1 and 1A. When the ends 70 are released, the spring members 74 will force the pins 63 to return in a rearward direction through the inclined slots 57 and 58 into the inner contracted position shown in FIG. 2.

The configuration of the die cavities 64 is dictated largely by the configuration of the connector sleeve of the fitting F as shown in FIGS. 1, 1A, 2 and 2A, the fitting F being loosely assembled onto a conventional coaxial cable C. The cable C is made up of an inner conductor R surrounded by an dialectic insulator S, an outer braided conductor T and an external jacket U. The cable end is prepared by removing a portion of the outer jacket U, braided conductor T and insulator S so as to expose an end of the conductor R. A portion of the braided conductor T is folded over a forward end of the jacket U for insertion into the fitting F in a manner to be described.

The fitting F is representative of various different types of compression connectors which can be utilized with the crimping tool of the present invention, and the fitting is comprised of inner and outer spaced concentric sleeves 74 and 76, the inner sleeve 74 terminating in a shoulder 77 which bears against a shoulder on ferrule or threaded end 78 which is adapted to be connected to a terminal, such as, a TV terminal. The outer concentric sleeve 76 terminates in an external shoulder 80 which bears against the opposite end of the ferrule 78 to the shoulder 77 on the inner sleeve 75.

Figure 2B:
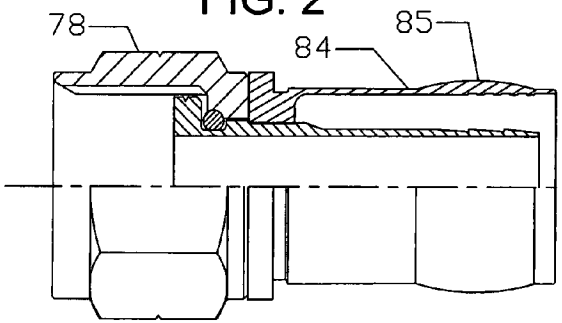
FIG. 2B is a sectional view of a preferred form of fitting prior to the crimping operation.

A novel feature of the fitting F is the shape of the outer connector sleeve 76 which has a thin-walled portion 82 of substantially uniform diameter and a thickened portion 84 at its trailing end having an outer raised or convex surface 85 opposite to an inner surface having alternating endless ribs 86 and grooves 87, as shown in FIG. 2B, the ribs 86 customarily referred to as sealing rings. As shown in FIG. 1A, the die cavities 64 are correspondingly formed with a conical surface 88 which flares outwardly toward the leading end of its die block 66 facing the body 12, a second more sharply inclined surface 89, a third oppositely inclined surface 90, a fourth generally convex surface 91 which corresponds to the configuration of the convex surface portion 85 of the connector sleeve 76 and a fifth generally conical surface diverging rearwardly away from the body 12 and terminating in a grooved surface portion 93. Overall, the cavity is dimensioned to slope in an inward radial direction from the leading end 88 to a diameter slightly less than the outer diameter of the convex section 85 and then undergo a further reduction in diameter 91 to a diameter substantially corresponding to the external diameter of the sleeve section 82. In this way, when the die halves are in their inner contracted position as shown in FIG. 2 and the plunger 14 is advanced by pivoting the handle 18 downwardly, the chuck 36 will force the fitting F rearwardly to move the thickened portion 84 of the sleeve 76 initially into engagement with the conical portions 88, 89 of the die cavities; the portion 84 will advance thereafter into engagement with the convex portion 91 of the cavity thereby causing the thickened portion 84 and adjacent portion 82 of the connector sleeve to be compressed radially into crimping, sealed engagement with the cable end C and such that the ribs 86 in the inner wall surface will assume a generally convex cross-sectional configuration as shown in FIG. 2C. Accordingly, the maximum amount or degree of crimping will occur along the thickened portion 84 rearwardly of the guide pins 63 thereby exerting a progressively increased closing force forwardly of the guide pins 63 and keep the die members closed during the forming operation notwithstanding slight variations in manufacturing tolerance or wear during use. In this relation, the location of the guide pins 63 assures that the dies will be properly held in position during the crimping operation, since the center line of the guide pin 63 is centered on the recess that generates the crimping operation, and the arm members 68 will control the attitude of the die members as they slide rearwardly through the slots 57, 58 and 59. Specifically, these features overcome the wear and misalignment problems inherent in the utilization of die halves that open and close about a fixed pivot.

In practice, the die members 61 and 62 are manually pressed forwardly into their expanded positions as illustrated in FIG. 1A, and the cable end C is inserted into the fitting F with the outer braided portion T which is doubled over the jacket U being inserted into the annular space between the inner and outer concentric sleeves 75 and 76. In other words, the pins 63 will slide freely through the slots 57 and 58 when the plunger 14 is retracted by lifting of the handle 18 and manual pressure is applied to advance the arms 68 in a forward direction against the urging of the springs 74. In the alternative, assuming that the die halves are in their normal contracted position in flush contacting relation to one another, when the fitting F and cable end C are inserted forwardly through the die support the fitting F will force the die halves 61 and 62 to slide forwardly and outwardly along their respective guideways 46 and 46' to the position illustrated in FIG. 1A. Once the fitting F clears the die halves 61 and 62, the die halves will return to their inner contracted position, as shown in FIG. 2, under the urging of the compression spring members 74. As previously described, the handle 18 can be pivoted to force the sleeve members 74 and 76 rearwardly through the die halves 61 and 62 until the threaded end 78 and shoulder 80 abut entrance 88 to the cavity at which point the crimping operation is completed as shown in FIG. 2A. In this relation, the slotted portions 59 are angled on the order of 5° to 7° to the longitudinal axis of the die support 44 so as to minimize any tendency to jam at the completion of the crimping stroke.

As the chuck applies continued pressure in forcing the fitting F rearwardly through the die members 61 and 62, the pins 63 will absorb some of the thrust in advancing along the inner slotted portions 59 but the major part of the thrust will be absorbed by the spring-loaded chuck member 63. Once the crimping operation is completed, the die members 61 and 62 can be advanced forwardly by manually sliding the arm portions 68 against the urging of the spring members 74 to return the die members to the expanded position as shown in FIGS. 1 and 1A and permit the crimped fitting F and cable C to be removed.

DETAILED DESCRIPTION OF ANOTHER EMBODIMENT

Figure 6:
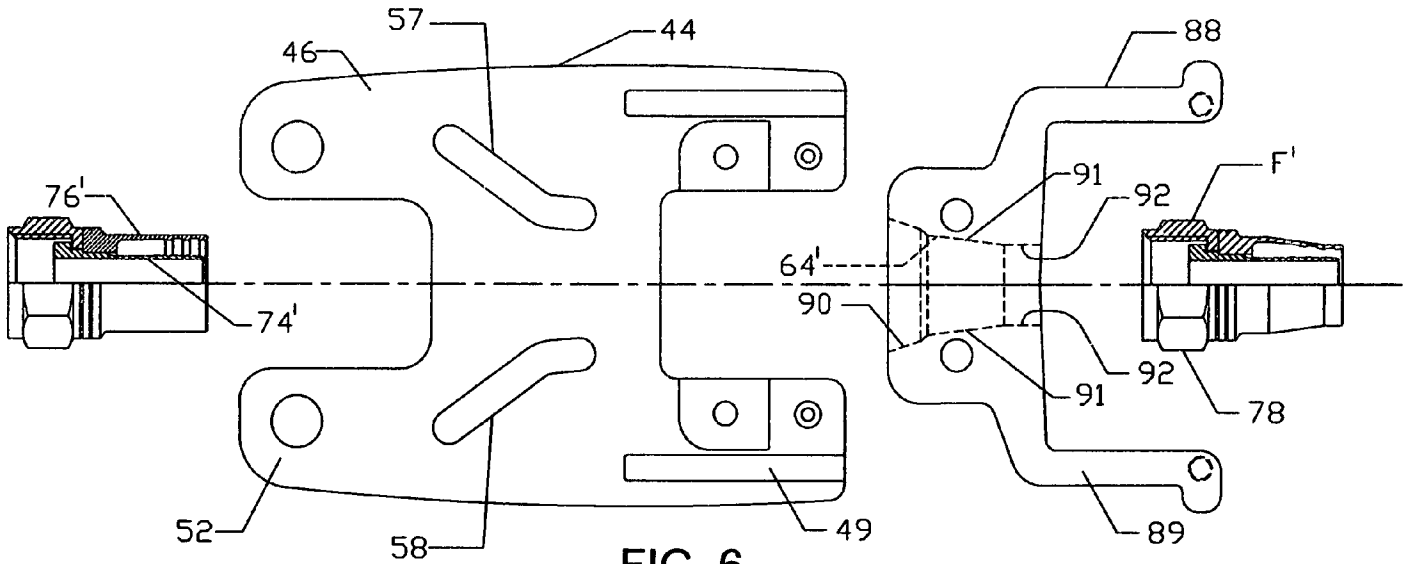
FIG. 6 is a detailed view of another preferred form of die and die support.
Figure 4:
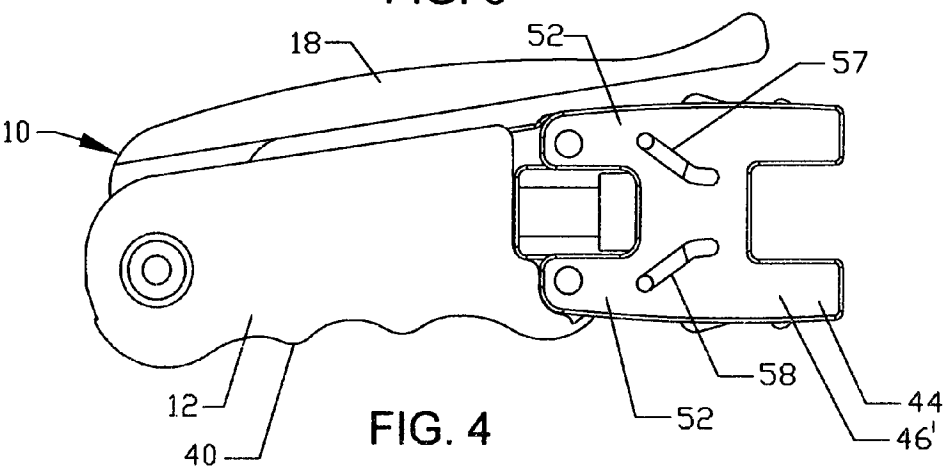
FIG. 4 is a side view of the preferred form of crimping tool.

FIG. 6 illustrates another form of invention in which like parts to those of FIGS. 1 to 5 are correspondingly enumerated. Thus, the die support 44 corresponds to that of FIGS. 1 to 5 but the die halves 88 and 89 are provided with more of a straight conical cavity 64' consisting of a first wide angle conical portion 90 converging into an intermediate, relatively low angle conical portion 91 and a third portion 92 of relatively uniform diameter. This is designed more for use with a fitting F' having inner and outer concentric connector sleeves 74' and 76' in which outer sleeve 76' is of uniform or substantially uniform thickness.

The die cavities 64' are dimensioned such that when the fitting is forced rearwardly by the plunger the outer connector sleeve 76' will initially contact the conical portion 91 and undergo inward radial contraction as it advances through the conical portion 91 until the crimping operation is completed and force the outer connector sleeve into a conical cross-section firmly engaging the outer exposed portion of the cable end C.

It is therefore to be understood that while different embodiments are herein set forth and described, the above and other modifications may be made therein without departing from the spirit and scope of the invention as defined by the appended claims and reasonable equivalents thereof. For example, while the crimping tool of the present invention has been found to be particularly effective in combination with the coaxial cable fittings of FIGS. 1 to 5 and 6, other crimping tools may be utilized, such as, those having pivotal die members. Also, the crimping tool of the present invention is conformable for use with different types of coaxial cable fittings and may be dimensioned accordingly.

We claim:

1. A crimping tool adapted to connect the sleeve portion of a cable fitting to an end of a cable wherein said tool is provided with a cable receiving die support at one end, an elongated body having a plunger mounted for axial advancement through said body toward and away from said cable-receiving die support including means for axially advancing said plunger toward and away from said die support, the improvement in said tool comprising:

a plurality of die members mounted in said support for movement between a radially expanded position in which said cable fitting is slidable into contact with said plunger and a contracted position in which said die members are slidable into a radially contracted position, biasing means for yieldably urging said die members toward said contracted position, and wherein relative advancement of said sleeve portion and said die members into engagement with one another causes said sleeve portion to be contracted into crimping engagement with said cable end.

2. A crimping tool according to claim 1 wherein said die members are slidable radially and axially into said contracted position.

3. A crimping tool according to claim 1 wherein said biasing means is defined by a plurality of resilient members.

4. A crimping tool according to claim 3 wherein said resilient members are springs.

5. A crimping tool according to claim 1 wherein said die members define circumferential portions of a tapered cavity, at least one of said die members being movable into and out of circumferential alignment with the other of said die members.

6. A crimping tool according to claim 5 wherein said die members each include a cavity having a first diameter at a first end corresponding to an inner diameter of said sleeve and a second diameter axially spaced from said first diameter which corresponds to an outer diameter of said cable end.

7. A crimping tool according to claim 5 wherein each of said die members has guide members slidable through guideways in opposite sides of said die support to advance said die members between said expanded and contracted positions.

8. A crimping tool according to claim 7 wherein each of said die members includes a pair of said guide members on opposite sides of said die portions, each of said guide members being slidable through one of a pair of spaced guideways on said opposite sides of said die support.

9. A crimping tool according to claim 8 wherein a pair of said guideways are inclined slots inclining along each of said opposite sides of said die support.

10. A crimping tool for crimping the sleeve portion of a cable fitting to an end of a coaxial cable wherein said tool is provided with an elongated body having a cable-receiving recess at one end, a plunger mounted for axial advancement through said body toward and away from said cable-receiving recess including a pivotal handle for axially advancing said plunger toward and away from said recess, the improvement in said tool comprising:

a die support having spaced guideways;

a plurality of die members mounted between guideways for movement between an expanded position in which said cable fitting is slidable into contact with said plunger and a contracted position in which said die members are movable into a radially contracted position causing said sleeve to be contracted into crimping engagement with said cable end and wherein each of said die members has guide members slidable through said guideways in opposite sides of said die support to advance said die portions between said expanded and contracted positions.

11. A crimping tool according to claim 10 wherein said die members are slidable radially and axially into said contracted position in response to axial advancement of said plunger forcing said fitting through said recess.

12. A crimping tool according to claim 11 wherein biasing means are provided for yieldingly urging said die members toward said contracted position.

13. A crimping tool according to claim 10 wherein said die members define semi-circumferential portions of a cavity, at least one of said die members being movable into and out of circumferential alignment with the other of said die members.

14. A crimping tool according to claim 13 wherein said die members each include a cavity having a first diameter at a first end substantially corresponding to an outer diameter of said sleeve and a second diameter axially spaced from said first diameter which substantially corresponds to an inner diameter of said cable end.

15. A crimping tool according to claim 14 wherein said cavity includes an inner convex surface portion.

16. A crimping tool according to claim 10 wherein each of said die members includes a pair of said guide members on opposite sides of said die members, each of said guide members being slidable through one of a pair of spaced guideways on said opposite sides of said channel.

17. A crimping tool according to claim 16 wherein said guideways are defined by inclined slots along each of said opposite sides of said channel.

18. In combination:

a fitting for electrically and mechanically connecting a cable having at least one electrically conductive member to another electrically conductive member, said fitting including a sleeve member at one end for insertion of said one electrically conductive member, said sleeve member having a raised portion of increased diameter in relation to the remaining length of said sleeve member; and a crimping tool including a cable-receiving die support at one end, and a plurality of die members defining circumferentially extending concave portions of a tapered conical cavity, said die members mounted in said support for movement between an open position in which said sleeve member is slidable into contact with one end of said die members and a contracted position in which relative advancement of said sleeve members and said die members into engagement with one another causes said raised portion to be compressed into crimping engagement with said cable end.

19. The combination according to claim 18 wherein said raised portion is of a generally convex configuration, and said die members include a cavity into which said sleeve is inserted.

20. The combination according to claim 19 wherein said cavity includes an inner convex surface portion engageable with said raised portion to cause said raised portion to be compressed into crimping engagement with said cable end.

21. In combination, a fitting for electrically and mechanically connecting a coaxial cable having inner and outer spaced electrically conductive members to another electrically conductive member, said fitting including inner and outer concentric sleeve members at one end for insertion of said outer spaced electrically conductive member therebetween, said outer concentric sleeve member having a thickened portion of increased diameter in relation to the remaining length of said sleeve member with an outer generally convex surface; and a crimping tool including a cable-receiving die support at one end, an elongated body having a plunger mounted for axial advancement through said body toward and away from said die support, and a plurality of die members mounted in said support for movement between a radially expanded position in which said fitting is slidable through said support into contact with said plunger and a contracted position in which said die members are slidable into a radially contracted position in which relative advancement of said sleeve members and said die members into engagement with one another causes said outer concentric sleeve member to be compressed into crimping engagement with said cable end.

22. The combination according to claim 21 wherein said thickened portion is at a trailing end of said cable fitting.

23. The combination according to claim 22 wherein said outer concentric sleeve member has axially spaced, circumferentially extending sealing rings on its inner wall surface opposite to said outer convex surface portion.

24. The combination according to claim 21 wherein said die members define circumferential portions of a cavity and are movable into circumferential alignment, said cavity having an axially extending convex configuration movable into engagement with said thickened portion in response to said relative axial movement between said sleeve members and said die members thereby contracting said outer sleeve member into crimping engagement with said cable end.

25. The combination according to claim 24 wherein said relative axial advancement between said sleeve members and said cavity causes said thickened portion to be compressed into an inner convex surface portion in crimping engagement with said cable end.

* * * * *